US006324291B1

(12) United States Patent
Weidner

(10) Patent No.: US 6,324,291 B1
(45) Date of Patent: Nov. 27, 2001

(54) HEAD-WORN HEARING AID WITH SUPPRESSION OF OSCILLATIONS AFFECTING THE AMPLIFIER AND TRANSMISSION STAGE

(75) Inventor: Tom Weidner, Nuernberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 09/326,534

(22) Filed: Jun. 7, 1999

(30) Foreign Application Priority Data

Jun. 10, 1998 (DE) ..... 198 25 998

(51) Int. Cl.[7] ..... H04R 25/00

(52) U.S. Cl. ..... 381/322; 381/312; 381/324; 381/330; 181/129

(58) Field of Search ..... 381/322, 324, 381/330, 381, 382, 327, 328, 312, FOR 135, 137; 181/129, 130, 135

(56) References Cited

U.S. PATENT DOCUMENTS

| | | | | |
|---|---|---|---|---|
| Re. 26,174 | * | 3/1967 | Leale . | |
| 2,975,244 | * | 3/1961 | Lehr . | |
| 3,170,046 | * | 2/1965 | Leale . | |
| 3,239,093 | * | 3/1966 | Gath . | |
| 3,819,860 | * | 6/1974 | Miller . | |
| 4,617,429 | * | 10/1986 | Bellafiore . | |
| 4,729,451 | * | 3/1988 | Brander et al. | 181/130 |
| 4,870,688 | * | 9/1989 | Voroba et al. . | |
| 4,962,537 | | 10/1990 | Basel et al. . | |

FOREIGN PATENT DOCUMENTS

| | | |
|---|---|---|
| 1 139 549 | 11/1962 | (DE) . |
| 3 324 802 | 12/1973 | (DE) . |
| 77 07 822 | 9/1978 | (DE) . |
| 32 09 397 | 12/1982 | (DE) . |
| 06 16773 | 11/1987 | (DE) . |
| 93 08 492 | 12/1994 | (DE) . |
| 195 02 994 | 8/1995 | (DE) . |

* cited by examiner

*Primary Examiner*—Sinh Tran
*Assistant Examiner*—P. Dabney
(74) *Attorney, Agent, or Firm*—Schiff Hardin & Waite

(57) ABSTRACT

A head-worn hearing aid has a housing composed of two mating shells which contain components including at least one signal receiver, an amplifier and transmission stage, an earphone and a battery. The hearing aid also has formed parts of elastic material disposed in the housing shells, these formed parts lying against the amplifier and transmission stage at both sides when the housing equipped with the device parts is closed, and filling the interspace between the amplifier and transmission stage and the interior surfaces of the housing shells, and holding the amplifier and transmission state in place in the housing.

10 Claims, 1 Drawing Sheet

HEAD-WORN HEARING AID WITH SUPPRESSION OF OSCILLATIONS AFFECTING THE AMPLIFIER AND TRANSMISSION STAGE

BACKGROUND OF THE INVENTION

1. Field of the Invention

The present invention is directed to a hearing aid of the type to be worn at the head, having a housing composed of two mating shells that accepts components of the device such as at least one signal receiver, an amplifier and transmission stage, an earphone and a battery.

2. Description of the Prior Art

German OS 11 39 549 discloses a hearing aid to be worn behind the ear that has a housing composed of two cover shells and a plate-shaped middle part in which a microphone, an amplifier, an earphone, a battery, etc. are arranged. In order to be able to utilize the full amplification of the device and in order to shield the microphone from the sound which emanates from the earphone and is conducted via the air ad via the hearing aid structure, the housing chamber which contains the earphone is sealed from the housing chamber which contains the microphone. To that end, sealing ribs projecting from the cover shells lie directly on the surfaces of the plate-shaped middle part and are intended to keep the acoustic waves of the earphone away from the microphone. Instead of ribs, sound-damping material can also be used, this being placed between the plate-shaped middle part and the cover shells. A combination of sealing ribs and sound-damping material is also possible. All of these measures are intended to serve for the suppression of feedback between the acoustic transducers.

Hearing aids with housing shells as in the case of hearing aids to be worn at the head and, in particular, to be worn behind the ear or to be worn at hearing aid glasses usually have thin plastic housing shells containing at least one microphone and/or an induction coil, an earphone, a battery as well as an amplifier and transmission part. In such hearing aids it has been found that oscillations of the housing parts and/or of the hearing aid components can occur due to self-resonance and/or outside excitation. In particular, a printed circuit board component of the amplifier and transmission stage can be effected by these oscillations. This leads to feedback problems which are different from the aforementioned feedback addressed in German AS 11 39 549. These different feedback problems associated with the amplifiers and transmission stage can cause malfunctions in the transmission behavior of the hearing aid.

SUMMARY OF THE INVENTION

It is an object of the present invention to provide a hearing aid of the type initially described, wherein feedback problems which can produce a disturbing influence on the amplifier and transmission stage are avoided.

In a hearing aid of the type initially described, this object is achieved by introducing formed parts of elastic material into the housing shells, these formed parts pressing against the amplifier and transmission part at both sides when the housing, equipped with the device components, is closed and filling the interspace between the amplifier and transmission part and the insides of the housing shells, and arresting the amplifier and transmission part in the housing. Inventively, the oscillations at the housing parts and at the amplifier and transmission stage that cause the aforementioned transmission behavior disturbances in the hearing aid are avoided by the formed parts and their arrangement in the housing. Differing from built-in hearing aid parts that are cast integrally to form modules that, given a malfunction or given a change of the transmission characteristic, must be completely replaced, the formed parts in the invention can be removed from the amplifier and transmission stage, or from the further built-in hearing aid components after opening the housing, and changes at the build-in hearing aid parts can be carried out.

In an embodiment of the inventive hearing aid, the amplifier and transmission part is composed of a folded, multi-layer printed circuit board unit, and formed parts are also arranged between the printed circuit board layers.

In another embodiment of the invention those sides of the formed parts in contact on the amplifier and transmission stage respectively form a negative impression of the surface of the amplifier and transmission stage facing toward them. According to this embodiment, an especially effective support is achieved between the printed circuit board layers and the electrical and electronic component parts of the amplifier and transmission stage arranged thereon, as well as support by the inside walls of the housing shells.

In order to avoid vibration at the housing shell edges along the seam of the housing, a seal, for example a silicone or rubber seal, is provided in the seam between the housing shells.

The formed parts are manufactured of an elastically yielding material such as, for example, an elastic impression compound, of silicone, foamed plastic or soft rubber. The formed parts can be placed into the housing shells, or foamed, injected or glued into the housing shells.

DESCRIPTION OF THE PREFERRED EMBODIMENTS

Figure 1:
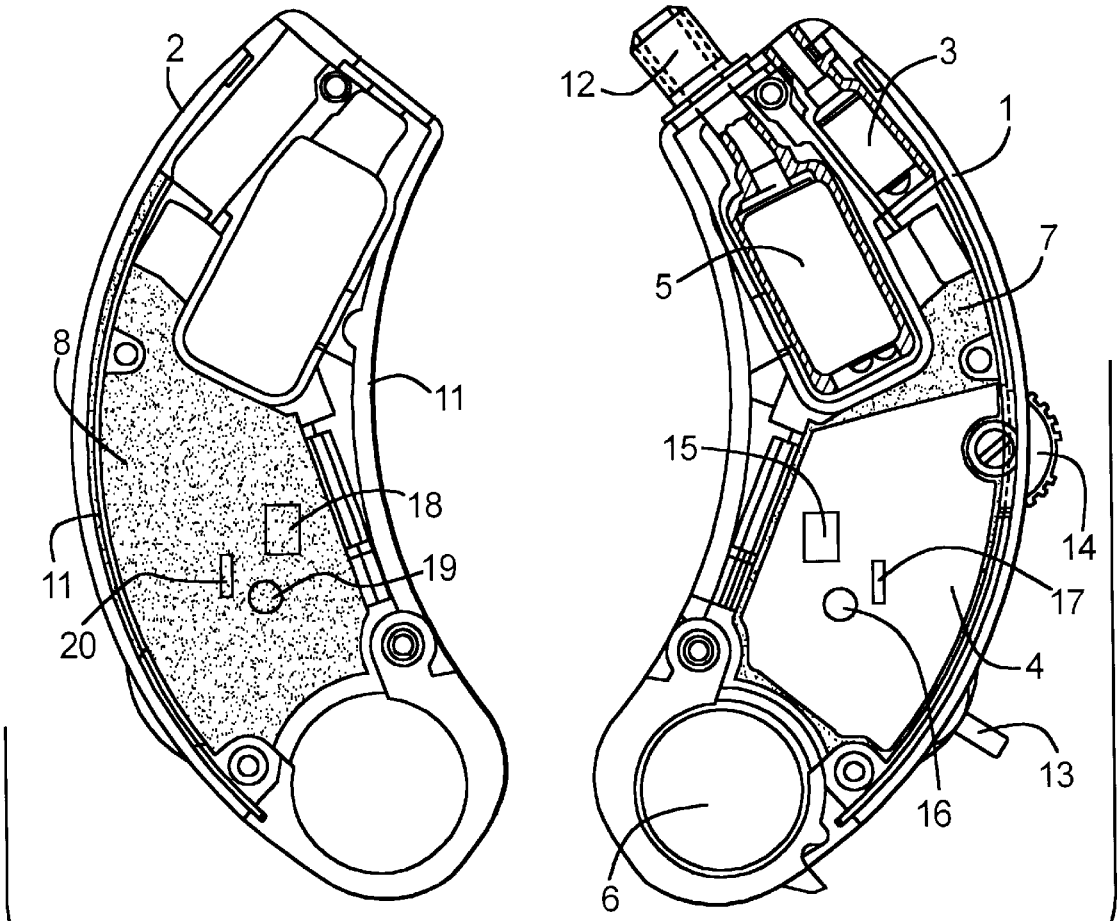
FIG. 1 schematically illustrates a BTE hearing aid constructed in accordance with the invention, with opened housing shells.
Figure 2:
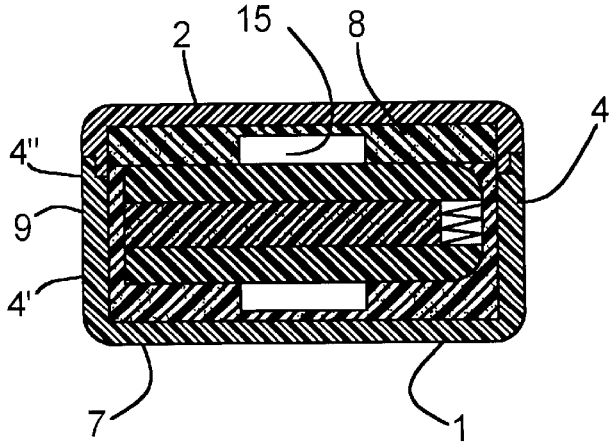
FIG. 2 shows a cross-section through a two-layer printed circuit board unit arranged in the closed housing of the hearing aid of FIG. 1, this being elastically supported against the housing shells by formed parts, with a further elastic formed part arranged between the printed circuit board layers.

A hearing aid to be worn behind the ear is shown in FIGS. 1 and 2 as an exemplary embodiment of an inventive hearing aid. The hearing aid housing is shown opened in FIG. 1, so that it can be seen that one housing shell 1 is equipped with a microphone 3 as a signal receiver, an amplifier and transmission stage 4 for signal processing, an earphone 5 as an output sound transducer and a battery 6 as a voltage source. Further, a sound connector 12 is provided to which a carrying hook (not shown) can be attached. The hearing aid has a manually actuatable switch 13 for switching the hearing aid on and off and manually actuatable a volume control 14.

A formed part 7 of elastic material is disposed in the housing shell 1 of the floor side. This formed part 7 supports the amplifier and transmission stage 4 against the inside wall of the housing shell and holding it in place.

The amplifier and transmission part 4 can be composed of a multi-layer, folded printed circuit board unit as shown in FIG. 2, in which case the printed circuit board layers 4', 4" thereof can be equipped with electrical and electronic hearing aid components 15, 16, 17, and further elastic formed parts 9 are placed between the printed circuit board layers 4, 4'.

A further elastic formed part 8 is, for example, glued into the second housing shell 2 fashioned as a cover part. When the housing is closed, then the formed part 8 of the cover side is directly on the amplifier and transmission stage 4 proceeding from above and supports and arrests t he amplifier and transmission part in the housing. Respective negative impressions 18, 19 and 20, of the components 15 through 17 are shown in the formed part 8 at that side facing toward the amplifier and transmission stage 4. In order to avoid oscillations between the edges of the housing shells 1, 2 a seal 11 of elastic material is provided in the housing seam.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid comprising:

a housing adapted to be worn behind an ear, said housing being composed of two mating, separable housing shells;

a plurality of hearing aid components disposed inside said housing shells, including at least one signal receiver, an amplifier and transmission stage comprising a printed circuit board with amplifier and transmission stage components thereon, an earphone, and a battery; and formed parts of elastic material also disposed in said housing shells, said formed parts lying against said amplifier and transmission stage at opposite sides thereof when said shells are closed with said components contained therein, said formed parts lying against and forming a negative impression of the amplifier and transmission stage components on said printed circuit board facing said formed parts and thereby filling interspaces between said amplifier and transmission stage components on said printed circuit board and interior surfaces of said housing shells for minimizing feedback, and holding said amplifier and transmission stage in place within said housing shells while still allowing selective removal of said hearing aid components from said housing shells when said housing shells are separated.

2. The hearing aid of claim 1 wherein said amplifier and transmission stage comprises a multi-layer, folded printed circuit board unit, and said improvement further comprising formed parts disposed between said printed circuit board layers.

3. The hearing aid of claim 1 wherein said formed parts are placed in said housing shells.

4. The hearing aid of claim 1 wherein said formed parts are foamed into said housing shells.

5. The hearing aid of claim 1 wherein said formed parts are injected into said housing shells.

6. The hearing aid of claim 1 wherein said formed parts are glued into said housing shells.

7. The hearing aid of claim 1 wherein said formed parts are composed of an elastic impression compound.

8. The hearing aid of claim 7 wherein said elastic impression compound is selected from the group of materials consisting of silicon, foamed plastic and rubber.

9. The hearing aid of claim 1 wherein said housing shells have a seam therebetween, and further comprising a seal disposed in said seam.

10. The hearing aid of claim 9 wherein said seal is comprised of a material selected from the group consisting of silicone and rubber.

* * * * *